United States Patent [19]

LaBianco

[11] Patent Number: 4,462,128

[45] Date of Patent: Jul. 31, 1984

[54] WAVE-REDUCING BAFFLE FOR WATER BEDS

[76] Inventor: Richard A. LaBianco, 1870 Port Charles, Newport Beach, Calif. 92660

[21] Appl. No.: 223,699

[22] Filed: Jan. 9, 1981

[51] Int. Cl.[3] ..... A47C 27/08

[52] U.S. Cl. ..... 5/450; 5/451

[58] Field of Search ..... 5/451, 450, 452, 449, 5/422; 220/88 R; 428/314.4, 314.8, 316.6

[56] References Cited

U.S. PATENT DOCUMENTS

| | | | |
|---|---|---|---|
| 3,748,669 | 7/1973 | Warner | 5/450 |
| 4,192,031 | 3/1980 | Fogel | 5/451 |
| 4,245,361 | 1/1981 | Evanson | 5/451 |
| 4,247,962 | 2/1981 | Hall | 5/451 |
| 4,296,510 | 10/1981 | Phillips | 5/450 |
| 4,301,560 | 11/1981 | Fraige | 5/450 |
| 4,332,043 | 6/1982 | Larson | 5/451 |
| 4,345,348 | 8/1982 | Hall | 5/451 |

*Primary Examiner*—Alexander Grosz

*Attorney, Agent, or Firm*—Christie, Parker & Hale

[57] ABSTRACT

A wave-reducing water mattress for water beds has a wave-reducing baffle comprising a flexible fibrous layer, preferably of polyester fibers, occupying a major portion of the horizontal area traversed by the water-filled mattress. The fibrous layer resists flow of water within the mattress so as to restrict wave motion within the mattress. The baffle preferably includes a low-density layer that floats the fibrous layer next to the top surface of the water-filled mattress for restricting topical wave motion at the top surface of the mattress. In one embodiment, the baffle comprises a pair of thin vertically spaced apart upper and lower fibrous layers and a thin low-density, non-water absorptive foam layer between the fibrous layers for floating the upper fibrous layer next to the top surface of the mattress, while the lower fibrous layer "anchors" the baffle within the mattress, without the baffle being attached or sealed to the wall of the mattress. Wave motion generated within the mattress is dampened in a water-filled chamber formed between the lower fibrous layer and the floating upper fibrous layer. In another embodiment, the lower fibrous layer and the floating upper fibrous layer are held in place spaced apart with respect to one another by a series of ties or button tufting mono-filament strings which resist wave forces generated within the inner chamber by preventing the two layers from expanding further than the strings allow.

12 Claims, 6 Drawing Figures

WAVE-REDUCING BAFFLE FOR WATER BEDS

BACKGROUND OF THE INVENTION

1. Field of the Invention

This invention relates to water beds, and more particularly to an improved baffle for restricting wave motion within a water-filled mattress of a water bed.

2. Description of the Prior Art

A disadvantage of a conventional water bed is that the water-filled mattress often is subjected to transverse wave action or sloshing which can be a disturbance to the user. Until this invention there were basically two techniques for reducing wave action in a water mattress. One approach was to seal vinyl baffles such as barriers, floats, or pods within the vinyl mattress to reduce internal wave motion. Portions of these vinyl baffles were sealed to the inside walls of either the upper and/or lower surfaces of the mattress. However, any time vinyl is sealed to vinyl, the region where the seal is located is susceptible to fracturing or leaking. This can be especially troublesome when the vinyl baffle is sealed to both the bottom and top interior surfaces of the water mattress.

Another approach has been to simply insert a light weight polyurethane foam slab into the interior of the water mattress. This method was probably first used in water-filled seat cushions for reducing sloshing, but application of this technique to a larger scale (inside a water mattress for a water bed) created several problems ignored or non-existent in the water-filled seat cushions. Such a foam baffle in a water mattress for a water bed resists emptying of the water from the mattress because it absorbs a tremendous amount of water and oftentimes ends up as a 400 pound clump of foam filled with water when the mattress is emptied. In addition, the foam pad resists the flow of water purification chemicals that must be used in a water mattress. The foam pad also hampers efficient and accurate heating of the water in the water mattress by hindering the upward flow of heater warmth to the upper surface of the mattress.

A mat of latex coated pig hair has also been used as an insert inside a baby crib water mattress. Similar to sisal fibers in stiffness, the pig hair mat was to prevent the baby from sinking to the bottom of the mattress in the event of a leak. Such a stiff fibrous mat would not be practical as a baffle in a water bed mattress.

None of the above approaches effectively resists wave motion to the extent that wave motion once induced can be quickly dampened. On the other hand, a system for reducing wave motion should not stiffen the support provided by the upper surface of the mattress, thereby losing the soft and supple characteristic of a water bed mattress.

Thus, there is a need to provide a baffle for a water bed mattress that can effectively resist wave motion without stiffening the support to body weight, while permitting free flow of water purification chemicals within the mattress and without hindering the transfer of heater warmth to the upper surface of the mattress.

SUMMARY OF THE INVENTION

Briefly, this invention comprises an improved baffle for a water bed mattress having a hollow interior for containing a body of water. A wave reduction baffle within the hollow interior of the mattress comprises at least one flexible fibrous layer occupying a major portion of the horizontal area traversed by the hollow interior of the mattress. The fibrous layer creates resistance to the flow of water within the mattress for restricting wave motion within the mattress. The fibrous layer is a mass of non-deteriorable, non-porous fibers formed as an integral flexible fibrous layer that resists the rapid flow of water within and around its fibers. The fibers, being non-porous, are essentially non-absorptive of liquid in layer form, unlike a resilient foam or sponge-like material. The fibrous layer readily releases water when the water mattress is drained, and the fibrous layer allows the free release of air bubbles within it, unlike a sponge or foam material. The fibrous layer also provides for fluid flow intake and expulsion sufficient enough for effective action of fungicides, or other water purification chemicals or additives within the mass of fibers in the fibrous layer.

One embodiment of the invention allows use of a sufficiently thin fibrous layer near the bottom of the mattress that heater warmth can transfer through the thin fibrous layer to the upper surface of the water mattress.

A preferred form of the invention includes a layer of low-density material for floating the fibrous layer next to the upper surface of the water mattress. The floating fibrous layer, in floating next to the upper surface of the mattress, provides an efficient means for restricting topical wave motion in the mattress. A water-filled chamber also is formed below the floating fibrous layer, and wave motion can be dampened in the chamber before it reaches the upper surface of the mattress.

These and other aspects of the invention will be more fully understood by referring to the following detailed description and the accompanying drawings.

DRAWINGS

DETAILED DESCRIPTION

Figure 1:
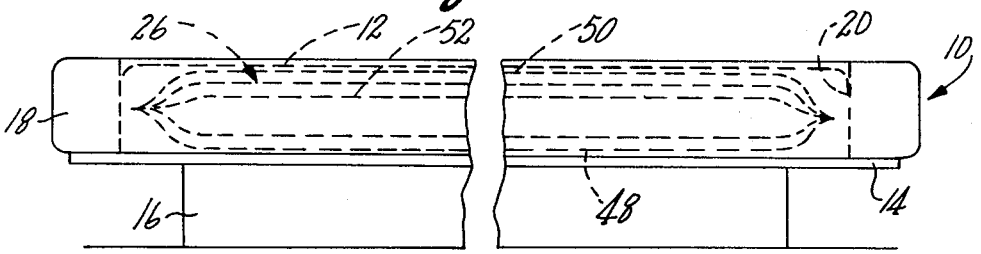
FIG. 1 is a fragmentary, semi-schematic side elevation view showing a water bed mattress with an improved baffle according to principles of this invention.

FIG. 1 shows a water bed 10 which includes a generally rectangular shaped water mattress 12 filled with water. The mattress can be any sealable and flexible water-tight material, preferably vinyl.

The bottom of the water-filled mattress rests primarily on the top surface of a flat rigid, preferably rectangular, platform or base 14. The platform is supported in a horizontal position at a desired elevation above the floor by a rigid lower supporting structure 16 which includes an upright rectangular frame assembled from elongated panels or riser boards, the ends of which are releasably connected to one another. The rectangular frame supports a peripheral portion of the platform 14. A number of upright supports (not shown), preferably formed by interlocking panels (not shown), can be located within the confines of the rectangular frame to support the structural portion of the platform.

A peripheral mattress support structure 18 rests on the top surface of the platform and extends around the perimeter of the platform. Since the platform is rectangular the peripheral support structure is also rectangular, with a separate length of the support structure extending along each edge of the rectangle. The peripheral portion of the water-filled mattress is supported laterally by the rectangular support structure. In the illustrated embodiment, the mattress support structure is generally rectangular and includes an upright support surface 20 for laterally supporting the peripheral portion of the water-filled mattress.

The water contained in the water mattress is heated to a desired temperature by an electrical heating element (not shown) that rests on the platform in contact with the bottom of the water mattress. The temperature of the water in the mattress is controlled by a thermostatic control that receives temperature information from a temperature sensor (not shown) that rests on the platform also in contact with the bottom of the water mattress.

A baffle 26 in the interior of the water mattress creates a natural resistance to the flow of water around it for the purpose of restricting wave motion within the water-filled mattress. The baffle illustrated at 26 in FIG. 1 is the same baffle shown in FIG. 5 and described in detail below.

The mere insertion of a baffle in the interior of a water mattress can be sufficient enough to satisfy for many users the desire to slow down wave motion in the water bed mattress. However, it is possible to improve the specific and subtle dynamics of wave motion restriction within a water bed mattress by various means which I have discovered through a series of developments, the progress of which will not be described.

Figure 2:
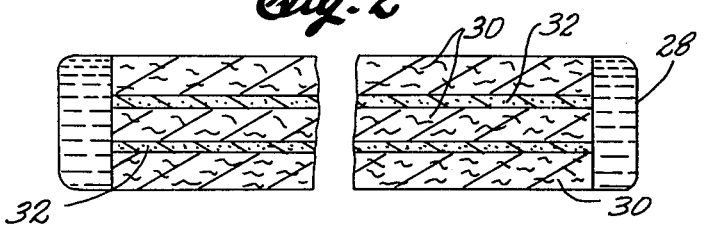
FIG. 2 is a fragmentary, semi-schematic cross-sectional view showing a baffle of fibrous layers essentially filling the interior of a water mattress.

FIG. 2 illustrates a multi-layer baffle occupying essentially the entire depth of a water-filled mattress 28. The multi-layer baffle also occupies a major portion of the horizontal area traversed by the water mattress. The baffle comprises three separate layers 30 of polyester fibers overlying one another and laminated together at each interface by corresponding layers 32 of adhesive. In one form the fibrous layers are bonded by layers of spray-on glue. Each fibrous layer is preferably approximately 3 inches thick, and each fibrous layer comprises a mass of polyester fibers which are adhered together to form an integral flexible sheet or batting. The fibers themselves are essentially non-porous, and the fibrous layers do not absorb water to the same extent that water is absorbed into a resilient plastic foam or sponge-like layer of the same thickness. The fibrous layers do not hinder effective action of fungicides or other water purification chemicals, and water can be easily expelled from the fibrous layers when draining the water mattress.

The baffle illustrated in FIG. 2 produces an almost absolutely waveless water mattress because the baffle totally fills the interior of the mattress. There is very little topical wave action at the upper surface of the mattress, because the fibrous layer is essentially held in a fixed position next to the upper surface of the mattress. There is no undulation of water within the mattress (i.e., from the flow of water upwardly from the bottom) because the baffle is essentially anchored on the bottom by its own settling and resistance to movement because of its own weight caused by "water-logging" (absorption of water around but not into the fibrous multi-layer baffle). The baffle in FIG. 2 tends to offer resistance to body weight on the mattress by stiffening the support otherwise provided by the normally soft and supple upper surface of the mattress. The multi-layer baffle also can hamper the heater function by concentrating the warmth generated by the heater to the general area around the heating element, rather than allowing a uniform transfer of heat through the water-filled mattress to the upper surface. Since the fibrous layers occupy essentially the entire depth of the water mattress, the fibrous layers can retain an undesirably large amount of water when the mattress is drained, even though the amount of water retained will be less than for a baffle of the same size made of foam or a sponge-like material.

Figure 3:
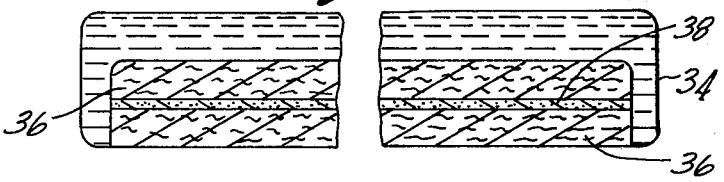
FIG. 3 is a fragmentary, semi-schematic cross-sectional view showing a baffle of fibrous layers in a lower portion of the water mattress.

FIG. 3 illustrates a multi-layer baffle occupying a portion of the depth of a water-filled mattress 34. The baffle comprises a pair of fibrous layers 36 overlying one another and bonded together at the interface by a layer 38 of adhesive. The fibrous layers 36 are identical to the fibrous layers in the embodiment of FIG. 2. Each layer is approximately 3 inches thick, leaving approximately 3 inches of water with no baffling immeditely beneath the upper surface of the water mattress. The mattress illustrated in FIG. 2 is semi-waveless because only a partial depth of the mattress interior is filled with the fibrous material. Since there is no fibrous layer near the upper surface of the mattress, the surface motion is similar to that in normal flotation (a water-filled mattress without baffling). This is generally undesirable because the highly mobile surface motion of the loose and flacid upper surface of the mattress is generally considered a nuisance to the user. On the other hand, the fibrous layer being "anchored" to the bottom of the water-filled mattress can eliminate undulating waves (waves caused by upward motion of water from the bottom), but the thickness of the fibrous layer being on the bottom of the mattress can hinder the heater function.

Figure 4:
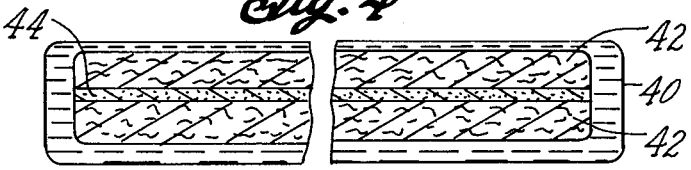
FIG. 4 is a fragmentary, semi-schematic cross-sectional view showing a baffle of fibrous layers adhered to and floated by a low-density foam layer.

FIG. 4 illustrates a floating multi-layer baffle occupying a portion of the depth of a water-filled mattress 40. The baffle comprises a pair of fibrous layers 42 overlying one another and secured together at the interface by a cellular low-density adhesive layer 44. The fibrous layers 42 are similar to the fibrous layers in the embodiments illustrated in FIGS. 1 and 2, i.e., each layer is approximately 3 inches thick and made of polyester fiber batting occupying a major portion of the horizontal area within the water-filled mattress. The thin cellular adhesive layer preferably comprises a mass of cellular spherical polystyrene beads in a resinous binder that adhesively bonds the two fibrous layers together. The cellular layer has a density much less than the density of water and reduces the overall density of the baffle sufficiently to cause the fibrous layers to float above the bottom surface of the mattress when the fibrous layers are immersed in the water contained in the mattress.

In the embodiment of FIG. 4 the floating baffle is essentially waveless, i.e., it produces very little topical wave action because the fiber floats next to the top surface of the water mattress. Since the baffle floats within the mattress at an elevation spaced from the bottom of the mattress, the baffle does not hamper heat flow from the heating element, resulting in effective heat transfer to the upper surface of the mattress. However, since the mass of the baffle is at the upper surface of the mattress, it exerts pressure tending to offer some resistance to body weight on the mattress. This can result in support which is somewhat more firm than desired in a water bed mattress. The floating baffle also can allow subtle undulations in the water because the baffle is a buoyant mass that floats in the mattress unanchored above the bottom surface, which does not completely dampen undulations travelling upwardly from the bottom.

Figure 5:
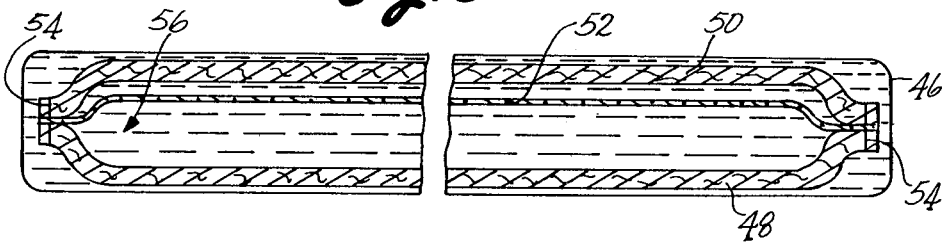
FIG. 5 is a fragmentary, semi-schematic cross-sectional view showing a baffle comprising a pair of fibrous layers and a floating low-density foam layer between them.

FIG. 5 illustrates a composite partially floating baffle in the interior of a water-filled mattress 46. The composite baffle comprises a lower fibrous layer 48, an upper fibrous layer 50 overlying but separated from the lower fibrous layer, and a low-density floating element 52 in the form of a thin flexible sheet of a cellular or foamed plastic material between the upper and lower fibrous layers. The flexible fibrous layers are thinner than the fibrous layers shown in the embodiments of FIGS. 2 through 4, the preferred thickness being about 1½ to 2 inches. Otherwise the fibrous layer are similar, being preferably made of polyester fibers and occupying a major portion of the horizontal area within the water mattress. The low-density floating element 52 preferably is 1/32-inch thick polyethylene cushion foam similar to a plastic sheet aerated with minute air pockets. Such a foam layer has a density much less than water and is non-porous, i.e., non-absorptive of water. The upper and lower fibrous layers and the intermediate foam layer overlie one another and are fastened together around their entire periphery by stitching 54.

When the composite baffle is inside a water-filled mattress the lower fibrous layer 48 settles and rests on the bottom surface of the mattress, anchoring the composite baffle within the mattress. The thin foam layer floats at a level spaced above the lower fibrous layer, and the foam layer floats the upper fibrous layer next to the upper surface of the water mattress. That is, the cellular foam layer applies buoyant forces to the upper fibrous layer, causing the upper fibrous layer to float next to the upper surface of the water mattress. The buoyancy of the floating foam layer could possibly cause the lower layer to float, in which case weights or the like could be added to the lower layer to ensure that the lower layer is anchored. When the mattress is filled with water the water seeps through the fibrous layers and the foam layer, forming a water-filled chamber 56 above the lower fibrous layer and below the floating fibrous layer. The illustration in FIG. 5 shows a small water-filled chamber between the upper surface of the foam layer and the lower surface of the upper fibrous layer. This illustration is intended to show that the upper fibrous layer is separate from the floating foam layer; although as a practical matter the upper fibrous layer tends to rest on the floating foam layer, i.e., the foam layer provides buoyant forces that support the upper fibrous layer next to the upper surface of the mattress.

The upper fibrous layer, being located at the upper surface of the water mattress, resists water flow at that level sufficiently to essentially elminate topical wave motion in the upper surface of the mattress. Any wave motion that is created is quickly dampened by the presence of the upper fibrous layer. The small amount of fiber provided near the upper surface of the mattress by the thin upper fibrous layer dampens wave action without offering any significant resistance to body weight on the mattress, thus maintaining the desired subtle or soft support characteristic of a water bed mattress. The lower fibrous layer being next to the bottom surface of the mattress, essentially eliminates undulating waves caused by water flowing across and upwardly from the bottom. Wave motion is further dampened in the water-filled chamber between the upper floated fibrous layer and the lower fibrous layer. Heat transfers readily through the thin lower fibrous layer and into the water-filled chamber toward the upper region of the mattress. Preferably, a large number of one-inch diameter holes are pre-cut in the foam layer to further allow heat transfer toward the upper surface of the water mattress. In addition the thin fibrous layers and the perforated foam layer allow for efficient passage of fungicides and other chemicals throughout the interior of the water mattress. The relatively small amount of fiber used in the composite baffle also makes drainage and handling easier since less water can remain around the fibers when compared with baffles having thicker fibrous layers.

Figure 6:
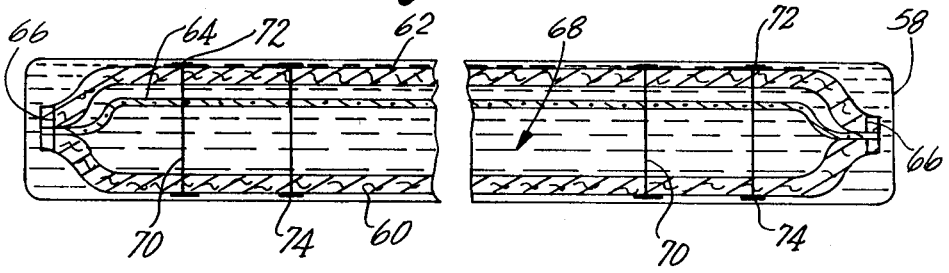
FIG. 6 is a fragmentary, semi-schematic cross-sectional view showing a baffle similar to the baffle of FIG. 5 with mono-filament tufting.

FIG. 6 illustrates a composite partially floating baffle similar to that shown in FIG. 5, comprising a lower fibrous layer 60, an upper fibrous layer 62, and a low-density floating element 64 between the upper and lower fibrous layers. The peripheral portion of the overlying upper and lower fibrous layers and the floating foam layer are fastened together by peripheral stitching 66. Use of the baffle is similar to the baffle of FIG. 5 in that the lower fibrous layer settles to the lower portion of the water mattress and the low-density foam layer 64 floats the upper fibrous layer next to the upper surface of the water mattress. The lower fibrous layer provides a means of restraining the floating fibrous layer within the mattress without being adhered (such as sealed) to the wall of the mattress. A water-filled chamber 68 is formed between the upper surface of the lower fibrous layer and the lower surface of the low-density foam layer.

In the embodiment of FIG. 6 the upper and lower fibrous layers are held in a fixed position relative to one another by spaced apart ties comprising button-tufting, stitch-tufting, or other similar means of securing the upper fibrous layer so that it is maintained in a reasonably fixed floating position spaced above and extending generally parallel to the settled lower fibrous layer. In the embodiment of FIG. 6 button-tufting is provided by a number of mono-filament flexible plastic threads 70. The mono-filament threads extend through the upper and lower fibrous layers and the floating foam layer. Buttons 72 secure the upper ends of the filaments to the upper fibrous layer and buttons 74 secure the lower ends of the filaments to the lower fibrous layer. The filaments are of uniform length and are uniformly spaced apart over the horizontal area of the two fibrous layers. The length of the filaments can vary somewhat, and can have as much as one inch of slack, if desired. The filament length is sufficient to maintain the upper fibrous layer at a fixed position at the desired floating level spaced above the lower fibrous layer. This enhances the ability of the mattress to eliminate waves by preventing the two fibrous layers from expanding or spreading apart because of wave forces generated within the water-filled chamber 68 between them. Otherwise, the baffle as shown in FIG. 6 has the same advantages as the baffle illustrated in FIG. 5.

Thus, a wave-reducing baffle is provided which can effectively limit wave motion at the upper surface of a water bed mattress. Although specific embodiments have been described, it should be understood that other various baffles can be used without departng from the scope of the invention. As one example, one or more floating fibrous layers could be used, if desired, each having an upper fibrous layer floated by a lower floating layer of nonporous cellular material adhered to the fibrous layer.

I claim:

1. A wave-reducing water bed mattress comprising:

a mattress having a hollow interior for containing a body of water;

a wave reduction baffle within the hollow interior of the mattress, the baffle comprising at least one flexible fibrous layer, and float means located below the fibrous layer for applying buoyant forces to said fibrous layer for causing the fibrous layer to float next to the upper surface of the mattress; and anchoring means comprising an additional fibrous layer spaced below the floating fibrous layer for forming a chamber, in which water is contained between the floating fibrous layer and the additional fibrous layer so that entry or exit of water into and out of the chamber is permitted only through the fibrous layers, and in which the additional fibrous layer rests on but is detached from the lower wall surface of the mattress when the mattress is filled with water, the additional fibrous layer being secured to the floating fibrous layer for restraining movement of the floating fibrous layer within the interior of the mattress.

2. A water bed mattress according to claim 1 in which the floating fibrous layer, the float means, and the additional fibrous layer overlie one another and are secured together at their periphery.

3. A water bed mattress according to claim 1 including tie means spaced apart across the fibrous layers for holding the fibrous layers in a fixed position relative to one another.

4. A water bed mattress according to claim 1 in which the float means comprises a layer of a cellular, nonwater absorption material with a density of less than the density of water.

5. A water bed mattress comprising:

a mattress having a hollow interior for containing a body of water; and a wave reduction baffle within the hollow interior of the mattress, the baffle comprising an upper flexible fibrous layer, a lower layer spaced below the upper layer, and float means comprising a low density layer for causing the upper fibrous layer to float next to the upper surface of the mattress, the lower layer resting on the lower surface of the mattress and anchoring the floating upper fibrous layer, and in which the upper fibrous layer and the lower layer are separate from one another, forming a hollow chamber for containing water between the upper and lower layers so that entry or exit of water into or out of the chamber is permitted only through the upper and lower layers.

6. A water bed mattress according to claim 5 in which the lower layer is detached from the wall of the mattress.

7. A water bed mattress according to claim 5 in which the low density layer is a flexible cellular layer of nonwater absorptive material that buoyantly supports the upper fibrous layer.

8. A water bed mattress according to claim 5 in which the low density layer comprises a layer of thin cellular plastic material.

9. A water bed mattress according to claim 5 including tie means fastening the upper and lower layers in a fixed position relative to one another.

10. A water bed mattress according to claim 5 in which the low density layer comprises a thin cellular layer of material between the upper and lower layers; in which the upper and lower and the cellular layer are separable from one another; in which the upper and lower layers and the cellular layer overlie one another; andincluding means fastening together the peripheral portions of the overlying layers.

11. A water bed mattress comprising:

a mattress having a hollow interior for containing a body of water; and a composite wave reduction baffle within the hollow interior of the mattress, the baffle comprising an upper flexible fibrous layer, float means comprising a low density layer for causing the upper fibrous layer to float next to the upper surface of the mattress, and anchoring means comprising a lower fibrous layer below the floating upper fibrous layer and adjacent the bottom surface of the mattress for restraining movement of the composite baffle within the interior of the mattress, the upper and lower fibrous layers forming a hollow chamber containing water in which entry or exit of the water into and out of the chamber is permitted only through the fibrous layers.

12. A waterbed mattress according to claim 11 in which each fibrous layer comprises polyester fibers.

* * * * *